United States Patent [19]

Beck et al.

[11] 4,066,220

[45] Jan. 3, 1978

[54] COPY PAPER STORING AND FEEDING APPARATUS

[75] Inventors: Christian A. Beck, Ridgefield; William A. Ross, Darien; James E. Burke, Norwalk, all of Conn.

[73] Assignee: Pitney-Bowes, Inc., Stamford, Conn.

[21] Appl. No.: 738,043

[22] Filed: Nov. 2, 1976

[51] Int. Cl.[2] ..... B65H 17/20; B65H 19/10

[52] U.S. Cl. ..... 242/55; 242/68.7; 312/40

[58] Field of Search ..... 242/55, 68.7, 58, 55.3, 242/55.53, 78.7; 312/39, 40, 41

[56] References Cited

U.S. PATENT DOCUMENTS

| | | | |
|---|---|---|---|
| 2,957,638 | 10/1960 | Schiller et al. | 242/68.7 |
| 3,480,222 | 11/1969 | Goodman et al. | 242/55.3 |
| 3,489,361 | 1/1970 | Marion et al. | 242/68.7 X |
| 3,829,185 | 8/1974 | Lloyd | 312/39 |
| 3,861,610 | 1/1975 | Landis et al. | 242/55 |

*Primary Examiner*—George F. Mautz

*Attorney, Agent, or Firm*—Martin D. Wittstein; William D. Soltow, Jr.; Albert W. Scribner

[57] ABSTRACT

An apparatus is disclosed for storing and feeding copy paper for a copying machine in which the copy paper is stored in roll form and is cut to desired length by measuring and cutting mechanism provided in the copying machine. The portion of the apparatus which supports the roll of copy paper is partially removable from the copying machine in order to make it accessible for loading relatively heavy rolls of copy paper into the storage apparatus, and the supporting structure for the copy paper roll is such that there are no end caps to fit over the ends of the core for the roll of copy paper thereby facilitating handling of the roll of copy paper.

5 Claims, 5 Drawing Figures

COPY PAPER STORING AND FEEDING APPARATUS

BACKGROUND OF THE INVENTION

Electrophotographic copying machines have long been well known, and are now available in many sizes and types and are provided with a variety of features which are intended to improve the efficiency and use of operation of these machines. One such feature, with which the present invention is concerned, is the manner in which copy paper is stored in the machine and is fed from a storage location to the operating components of the copying machine which utilize the copy paper. When copying machines first came on the market, they were generally of the type which used precut sheets of copy paper which was stored in a stack and fed sheet by sheet to the instrumentalities of the copying machine which utilized the paper. This proved to be a relatively satisfactory way of handling copy paper, except that this mode of operation inherently possessed two distinct disadvantages, one being the necessity for a somewhat complex feeding and separating mechanism, the other being the inability to provide copy paper in more than one length in the absence of duplicate storage and feeding facilities for different sizes of precut copy paper.

It became apparent that, by utilizing a roll of copy paper with an intermittent feeding mechanism and a cutting mechanism, it would be possible to provide sheets of copy paper of any desired length. Several ways of measuring the copy paper quickly came into the art, one being to feed the original document through the copying machine for copying and to feed copy paper in accordance with the measured length of the original document and to cut the copy paper after such measured length had been fed. It also became apparent in those machines which maintained the original document stationary during copying, that predetermined selected lengths of copy paper could be fed during each copying operation. Many manufacturers of copying machines are utilizing the roll copy paper option in preference to the cut sheet copy paper option.

One problem which arises in conjunction with using roll copy paper is that of the operator loading fresh rolls of copy paper into the copying machine, particularly when the operator, such as an office secretary, may not possess great strength. The problem is that as electrophotographic copying machines have become faster in operation, it is necessary either to reload the copying machine with greater frequency or to provide longer rolls of copy paper, each with its own disadvantage. To have to load the copying machine with greater frequency is inconvenient to the individual responsible for loading the machine and may tie up the availability of the machine for copying for considerable periods of time. On the other hand, large rolls of copy paper are very difficult to handle in that they are considerably heavy and bulky. For example, the approximate weight of a roll of copy paper for the copying machine with which the present invention is concerned is 15 pounds, and is about 10 inches in diameter and 8½ inches in width. It will be apparent that a package of this size is not easy to manipulate.

SUMMARY OF THE INVENTION

The present invention relates generally to electrophotographic copying machines and particularly to apparatus for storing and feeding copy paper for such machines.

The apparatus of the present invention is intended to overcome and, to a large extent, eliminate the problems encountered in loading large and heavy rolls of copy paper into electrophotographic copying machines as described in the preceeding section of this specification.

The principles of the present invention are embodied in an appartus for storing and feeding rolls of copy paper in a copying machine, which apparatus generally includes a frame mounted on the copying machine by any suitable mechanism which provides for relative movement between the frame and the copying machine so that the frame is movable with respect to the copying machine between an operative copy paper feeding position and an inoperative copy paper loading position. The frame carries a suitable support member for a roll of copy paper in which the roll is supported on its peripheral surface but yet is free to rotate on the support means when the frame is in either of the aforementioned positions. The copying machine has a feeding means for withdrawing copy paper from the roll and for feeding the copy paper into the machine, and there are guide means carried by the frame which defines a copy paper path from the supporting member to the paper feeding means of the copying machine.

In some of its more limited aspects, the invention provides for the support member being in the form of rotatable rollers on which the roll of copy paper rests so that the end openings of the core of the copy paper roll are available for grasping by the person loading the copy paper into the machine.

Also, the device is arranged such that the copy paper path extends initially outwardly of the copying machine so that the feeding rollers can be disposed adjacent an edge of the copying machine in order to minimize the necessity for threading copy paper into the copying machine through relatively inaccessible places.

Having briefly described the general nature of the present invention, it is a principle object thereof to provide an apparatus for storing and feeding copy paper for a copying machine in which the copy paper is in the form of a relatively heavy and bulky roll.

It is another object of the present invention to provide an apparatus for storing and feeding copy paper in which at least the storing portion of the apparatus is partially removable from the copying machine to facilitate loading a relatively heavy and bulky roll of copy paper into the storing apparatus by the operator of the copying machine.

It is a further object of the present invention to provide an apparatus for storing and feeding copy paper in which the roll of copy paper is supported for rotation on its peripheral surface, so as to eliminate the necessity for end caps which fit into the end openings of the core of the roll of copy paper.

It is a still further object of the present invention to provide an apparatus for storing and feeding copy paper in which the guide structure which defines the copy paper feed path is readily movable from an operable position in which it partially obstructs the accessibility of loading copy paper to an inoperative position in which the guide structure is completely removed from interference with the loading of the roll of copy paper.

It is yet another object of the present invention to provide an apparatus for storing and feeding copy paper which is relatively simple in construction and inexpensive to manufacture and which requires little or no maintenance.

These and other objects and advantages of the present invention will become more apparent from an understanding of the following detailed description of a preferred embodiment of the present invention when considered in conjunction with the accompanying drawings in which.

DETAILED DESCRIPTION OF THE INVENTION

Figure 1:
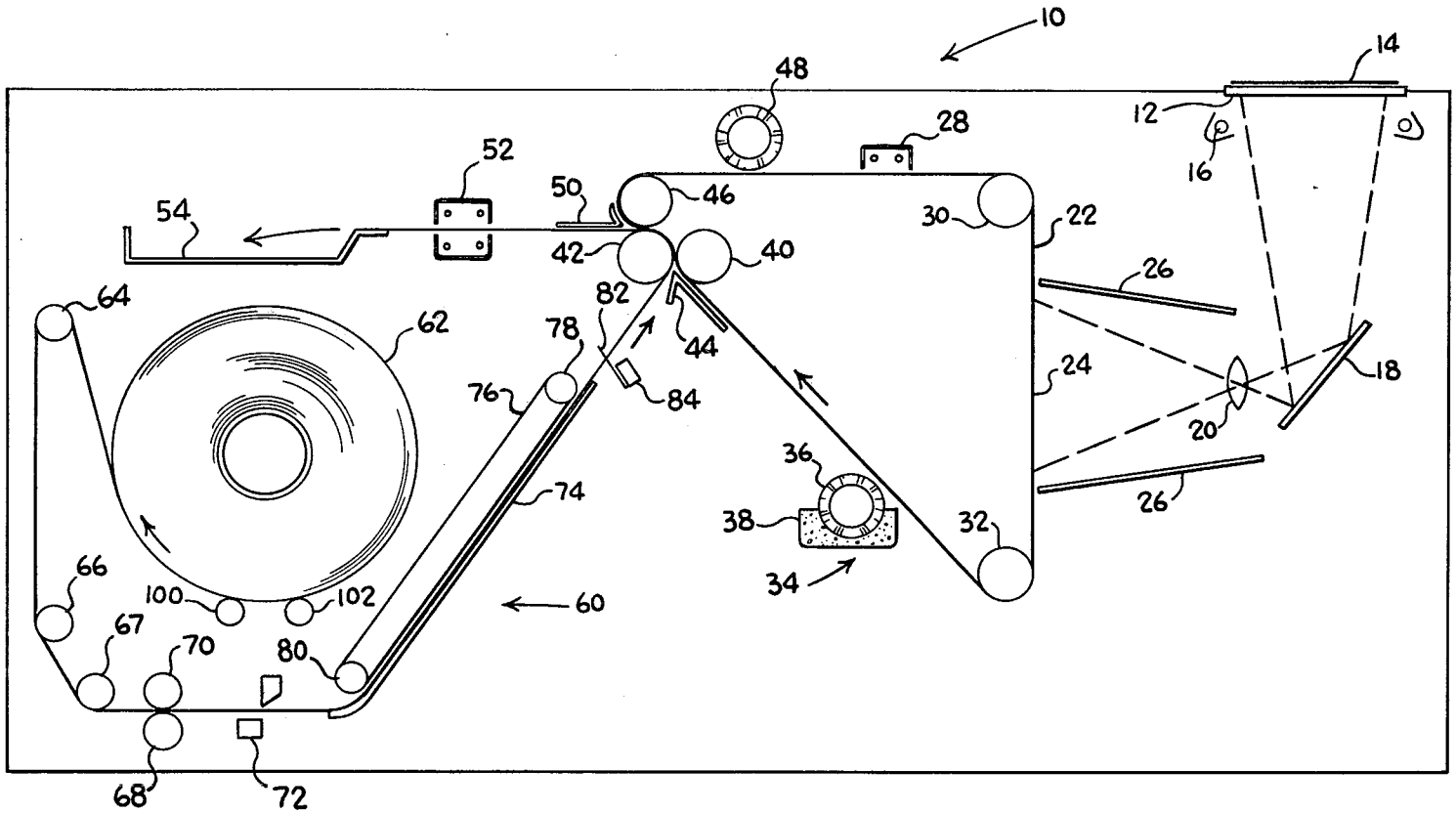
FIG. 1 is a diagrammatic longitudinal view of a copying machine embodying the principles of the present invention.

With reference to FIG. 1 of the drawings, the present invention is shown in association with an electrophotographic copying machine which is illustrated in entirely schematic form solely for the purpose of illustrating the manner in which the apparatus of the present invention can be associated with any type of electrophotographic copying machine. The copying machine, generally indicated by the reference numeral 10, comprises a transparent platen 12 on which a document 14 to be copied is placed. The document 14 is illuminated by lamps 16, which preferably are of the high intensity, short duration flash type lamps. An optical image of the document is reflected by the mirror 18 through a focusing lens 20 and onto the surface of a flexible photoconductor 22 within an area 24 defined by a light tight housing indicated by the lines 26 which define the exposure area 24 of the photoconductor belt 22.

The photoconductor 22 is generally triangular in configuration and, commencing with the upper right hand corner, the belt passes under a suitable corona charging device 28 which places a uniform electrostatic charge on the photoconductive surface. As is well known in the art, the electrostatic charge is dissipated in the light struck or background areas of the original document, but is not dissipated in the dark or image areas, as a result of the exposure of the photoconductor to the optical image of the document at the exposing areas 24. The photoconductor is guided in its path through the exposing area by the rollers 30 and 32. The photoconductor passes around the roller 32 carrying the latent charge image, which image is developed and rendered visible by a magnetic brush developing device 34, the construction and operation of which is generally well known in the art and forms no part of the present invention. Essentially, however, a rotating magnetic brush 36 carries magnetic developer material from a container 38 thereof and deposits toner material on the charge image on the photoconductor by the electrostatic attraction of the charge image on the photoconductor for the toner material, thereby forming a visible toner image.

The photoconductor 22 then passes between a pair of rollers 40 and 42 which define a nip at which copy paper is brought into contact with the photoconductor 22 for transfer of the toner image from the photoconductor to the copy paper. Any suitable form of paper guide 44 may be provided to assist in properly guiding the copy paper into contact with the photoconductor.

The transfer of the toner material from the photoconductor to the copy paper is accomplished while the copy paper and photoconductor are in contact with each other while passing the roller 42, and the transfer is accomplished by techniques well known in the art which need not be further described since they form no part of the present invention.

After the toner image is transferred to the copy paper, the photoconductor 22 is passed around a roller 46 and then under a cleaning device 48 which cleans any residual toner material from the photoconductor surface before the photoconductor again passes under the charger 28 to be reused in the manner just described.

The sheet of copy paper now carrying the toner image is separated from the photoconductor either by a suitable mechanical separator or simply by virtue of the fact that the radius of curvature of the roller 46 is small enough to cause the copy paper to separate from the photoconductor and continue in a straight line under the guide plate 50 rather than pass around the roller 46 with the photoconductor. The copy paper passes through any suitable fusing device 52 which raises the temperature of the toner material above its melting point and fuses it onto the copy paper so that the toner image becomes permanent. The copy paper is then deposited in the receptacle 54 for removal by the operator.

The copy paper storing and feeding apparatus, generally designated in FIG. 1 by the reference numeral 60, is located near an edge of the copying machine in order to place this apparatus in a convenient location for loading rolls of copy paper. The apparatus 60, which is shown only schematically in FIG. 1 and not necessarily to the scale of the rest of the apparatus shown in FIG. 1, comprises a means to rotatably support a supply roll of copy paper 62 and guide means in the form of rollers 64, 66 and 67 which define a feed path for the copy paper between the supply roll 62 and a pair of intermittently driven feed rollers 68 and 70 which feed the copy paper past a knife 72 which cuts the copy paper to a desired length by any suitable length determining mechanism. The cut sheets of copy paper are fed along an inclined plate 74 by a plurality of feed belts 76 which pass around rollers 78 and 80. A registering member 82 determines a prefeed position for a sheet of copy paper, the registering member being withdrawn by actuation of a solenoid 84 by any suitable timing mechanism so that the sheet of copy paper is brought into contact with the photoconductor 22 in proper registration with the developed toner image thereon. Suitable controls cause a new sheet of copy paper to be drawn from the supply roll 62 and severed, and fed to the aforementioned prefeed position in synchronism with the preceeding sheet of copy paper being brought into contact with the photoconductor for making a copy.

Figure 2:
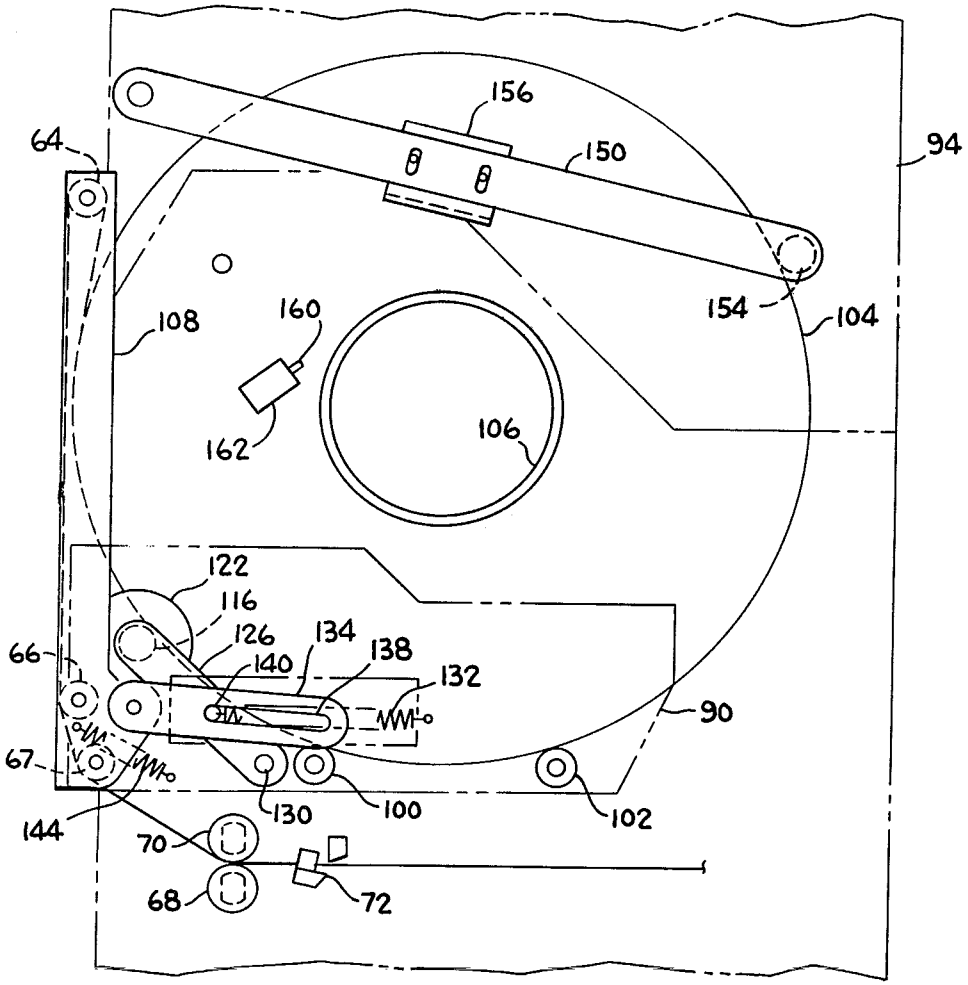
FIG. 2 is a side view of the copy paper storing and feeding apparatus utilized in the copying machine shown in FIG. 1 with a full roll of copy paper in storage position.
Figure 4:
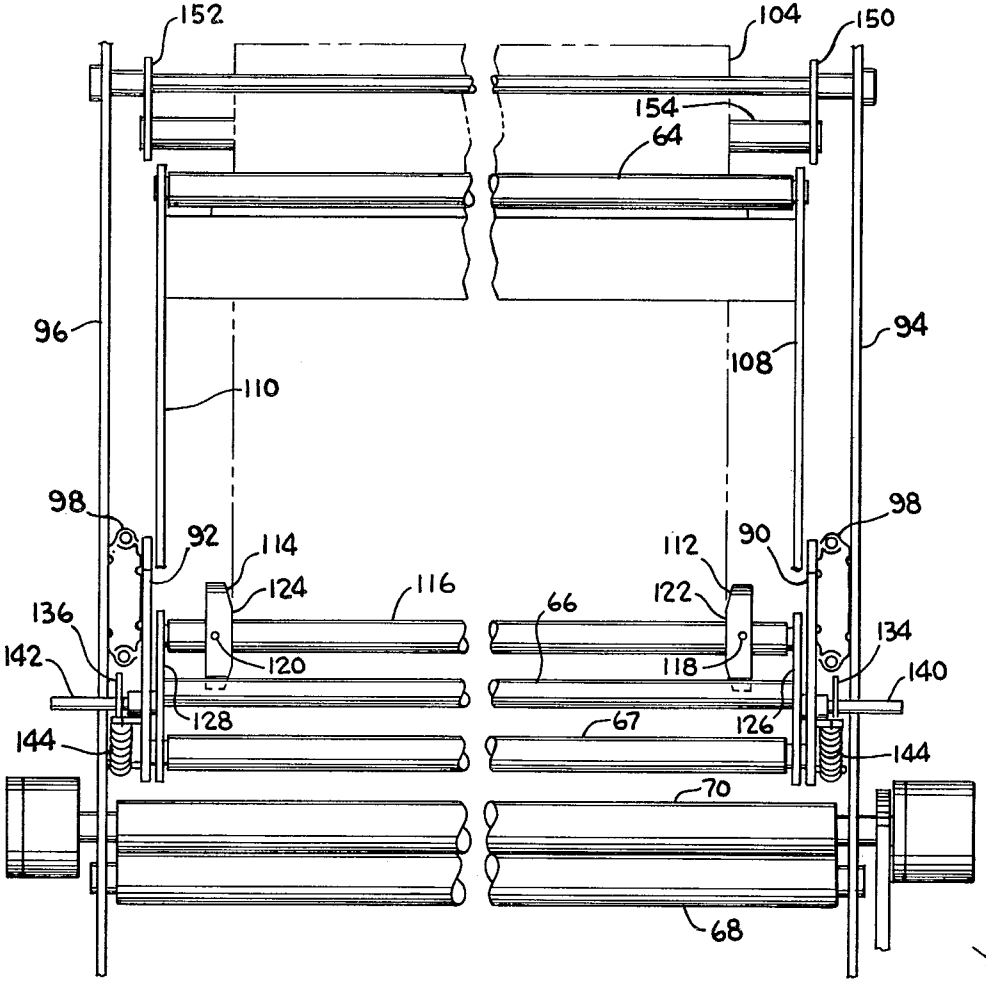
FIG. 4 is an end view of the structure shown in FIG. 3.

Referring now to FIGS. 2 and 4, it will be seen that the copy paper storing and feeding apparatus comprises a pair of side frame members 90 and 92 each of which are connected to the main side frame members 94 and 96 of the copying machine so as to be relatively movable with respet to the main side frame members 94 and 96 in a reciprocatory manner. Any suitable connecting means well known in the art such as the typical draw slide indicated generally by the numeral 98 in FIG. 4 will suffice to provide the necessary connection between the frame members 90 and 92 of the storing and feeding apparatus and the main side frame members 94 and 96 frame of the copying machine. By connecting the storing and feeding apparatus frame members to the copy machine in the manner described, the frame members, together with all of the structure to be described hereinafter mounted thereon, is movable with respect to the copy machine from an operative copy paper feeding position when the machine is in normal operation and an inoperative copy paper loading position which, as will be more clearly seen hereinafter, renders the copy paper storing and feeding apparatus completely accessible to the operator of the copying machine for loading rolls of copy paper therein.

Figure 3:
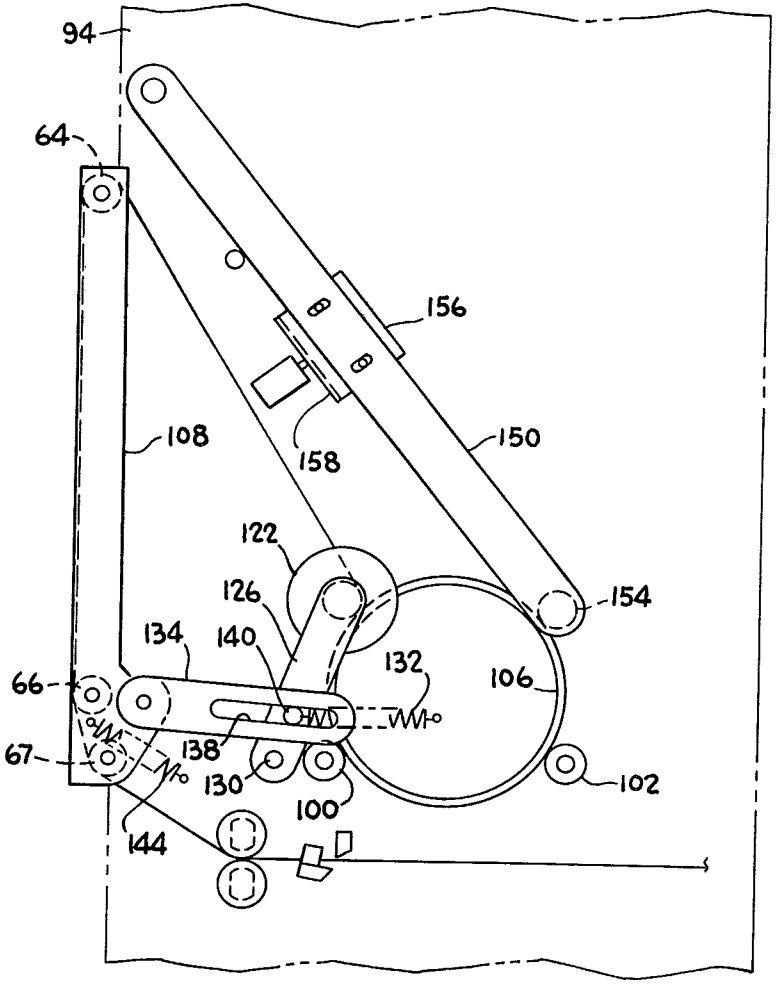
FIG. 3 is a view similar to FIG. 2 showing the position of parts when the roll of copy paper is exhausted.

Referring again to FIG. 2, it will be seen that the support means for the roll of copy paper comprises a pair of rollers 100 and 102 each of which is journalled for rotation in the side frame members 90 and 92 of the storing and feeding apparatus. The roll of copy paper 104 is provided with a relatively heavy cardboard or plastic core 106, the core 106 having a predetermined diameter. It will be seen that the linear spacing between the rollers 100 and 102 is less than the diameter of the core 106 so that the rollers 100 and 102 support the roll of copy paper as the roll is depeleted from a full to an empty condition as shown in FIGS. 2 and 3.

Figure 5:
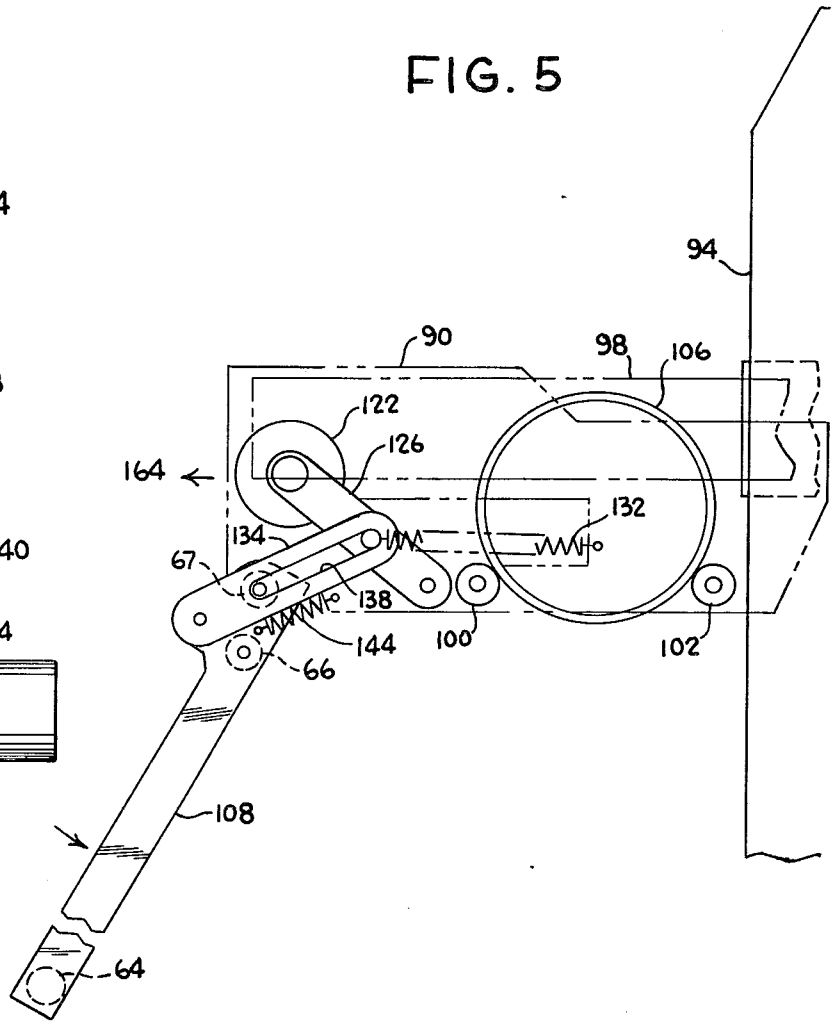
FIG. 5 is a fragmentary view of the structure shown in FIG. 3 with the copy paper guide structure in inoperative or loading position.

Referring to the paper guiding rollers 64 and 66 previously described and shown in FIG. 1, these rollers are more accurately shown in FIGS. 2 and 4 in which it is seen that the roller 64 is journalled for rotation at the upper ends of a pair of parallel bars 108 and 110 which constitute a subframe pivotally connected to the frame members 90 and 92 of the copy paper storing and feeding apparatus. The bars 108 and 110 are pivotally connected to the frame members 90 and 92 respectively at the lower ends of the bars 108 and 110 such that the bars are free to swing outwardly and downwardly as shown in FIG. 5. It will be seen that in this position the subframe is below the level of the copy paper supporting rollers 100 and 102 and is therefore completely removed from a position where it could interfere with loading a roll of copy paper.

The guide roller 67 is also mounted adjacent the lower ends of the bars 108 and 110, the roller 67 actually being mounted on the pivot axis of the bars 108 and 110. Since the roll of copy paper 104 is supported by the rollers 100 and 102 such that the copy paper peels off the roll adjacent the roller 64, it will be seen that the pull on the roll 104 is in a generally vertically upward direction from the time a full roll is placed on the support rollers until it is entirely used. Utilizing this direction of pull of the copy paper from the roll tends to eliminate any tendency for the outermost convolution of copy paper to unroll or loosen from the roll 104 before the copy paper has passed the last supporting roller before going over the guide roller 64. In addition to this advantage, by reversing the direction of the copy paper feed path and bringing it down the outside of the subframe bars 108 and 110 to the rollers 66 and 67, it is possible to maintain the copy paper feed rolls 68 and 70 relatively close to the outermost edge of the frame of the copying machine. This eliminates the necessity of feeding the web of copy paper into the machine when a fresh roll has been loaded in order to get the web of copy paper into the nip of the feed rollers 68 and 70 which would be necessary if these rollers, and the associated cutting knife 72, were located substantially further into the copying machine and therefore in relatively inaccessible position as is the case in many prior art machines.

A roll guiding mechanism is provided in order to keep the roll of copy paper 104 properly centered at all times so that the paper feeds smoothly and does not become wrinkled. As best seen in FIG. 4, a pair of chaser rollers 112 and 114 are mounted on a bar 116 on which the rollers 112 and 114 are axially adjustable by means of set screws 118 and 120. The chaser rollers are adjusted axially on the bar 116 so that the inner edge 122 and 124 of each chaser roller are just barely contacting the corresponding outer edges of the roll 104 of copy paper.

The bar 116 carrying the chaser rollers 112 and 114 is itself rotatably mounted on the upper ends of a pair of chaser links 126 and 128. The chaser links are themselves pivotally connected to the side frame members 90 and 92 as indicated by the numeral 130 in FIGS. 2 and 3. By comparing FIGS. 2 and 3, it will be seen that the chaser rollers follow the peripheral surface of the roll 104 of copy paper as the roll gradually decreases in size so that the guiding effect of the chaser rollers is exerted on the roll of copy paper until it is entirely used up. The chaser links 124 and 126 are urged in a clockwise direction around the pivot 130 by means of the chaser link springs 132 which are connected between the chaser links 126 and 128 and the frame members 90 and 92.

An interconnection between the chaser links 126 and 128 and the subframe bars 108 and 110 is provided so that the chaser rollers 112 and 114 are automatically withdrawn from contact with the copy paper roll 104 or the copy paper core 106 when the bars 108 and 110 are moved from the normal position shown in FIG. 3 to the paper loading position shown in FIG. 5. This interconnection is seen to comprise a pair of links 134 and 136 which are connected to the bars 108 and 110 respectively adjacent the lower end of these bars but just above pivot axis of these bars. Each of the links 134 and 136 has an elongate slot 138 through which pass the pins 140 and 142 projecting outwardly from the chaser links 126 and 128 and to which the springs 132 are connected. It will be seen by comparison of FIGS. 2 and 3 that as the chaser rollers move from the full copy paper roll position of FIG. 2 to the empty copy paper roll position of FIG. 3, the pins 140 and 142 move along the slots 138. The slots are of such a length that when the arms 108 and 110 are moved to their paper loading position as shown in FIG. 5, the right hand end of the slots engage with the pins 140 and 142. This moves the chaser links 126 and 128 away from the copy paper supporting rollers 100 and 102 because of the eccentric mounting of the links 134 and 136 to the lower ends of the arms 108 and 110 relative to the pivot axis of the arms 108 and 110. When the arms 108 and 110 are returned to their normal position as shown in FIG. 2, the chaser rollers 112 and 114 are returned to a position in contact with the edge of the copy paper roll 104 as above described. The arms 108 and 110 are normally maintained in their upright position by virtue of a pair of retaining springs 144 and 146 which are connected between the lower end of the arms 108 and 110 and the side frame plates 90 and 92, these springs being connected to the lower ends of the arms 108 and 110 in an over-center position with respect to the pivot axis 67 of the arms 108 and 110.

The invention also includes a means for exerting a small amount of braking or retarding action on the roll of copy paper, together with a means for providing a visual indication of when the supply of copy paper is substantially exhausted. Both of these functions have been combined into a relatively simple structure which is shown in FIGS. 2, 3 and 4. A pair of arms 150 and 152 are pivotally connected to the main side frame members 94 and 96 respectively of the copying machine and normally extend inwardly from the arms 108 and 110 along side of the roll of copy paper 104. The arms are connected together at the ends opposite the ends connected to the main frame members 94 and 96 by a non-rotatable bar 154 which normally rests on the peripheral surface of the copy paper roll. The bar 154 is formed of any suitable material which will provide a desired frictional drag on the roll of copy paper 104 in order to produce a predetermined resistance to rotation of the roll of copy paper. It is apparent that a rotatable bar or roller may be substituted for the bar 154 so long as the roller is provided with braking or resistance means to retard the rotation of the roller.

It will be apparent that as copy paper is consumed, the bar 154 and the arms 150 and 152 will follow the gradually reducing diameters of the roll of copy paper and the bar 154 will continue to exert the necessary braking or retarding force on the roll of copy paper as it is consumed.

A bracket 156 is secured to one of the arms 150 or 152, the bracket 156 having a suitable abutment portion 158 which is adapted to contact the actuating finger 160 of a switch 162 which is mounted in any convenient location in the copying machine so that the actuating finger 160 is contacted by the abutment portion 158 of the bracket 156 when the arms 150 and 152 are in the position shown in FIG. 3. The switch 162 can be placed in a circuit which either turns on a light, deenergizes the copying machine, or gives some other indication that the roll of copy paper is exhausted as is well known in the art.

In the operation of the above described apparatus, to load a roll of copy paper into the copying machine after the previous roll has been consumed, the frame 90 with all of the structure supported thereby is first moved in a left hand direction as indicated by the arrow 164 in FIG. 5 so as to dispose the storing and feeding apparatus in the non-operative or paper loading position which is outside of the copying machine. Thereafter, the subframe 108 and 110 is manually swung from the position shown in FIG. 3 to the position shown in FIG. 5, thereby withdrawing the chaser rollers 112 and 114 from contact with the empty core 106 of the copy paper roll. A new roll of copy paper is placed on the supporting rollers 100 and 102 with the free end of the copy paper extending outwardly relative to the copying machine. The subframe 108 and 110 is then returned to the vertical position which returns the chaser rollers 112 and 114 into contact with the peripheral edge of the roll of copy paper as shown in FIG. 2. The loading edge of the copy paper is drawn upwardly over the roller 64, then downwardly on the outside of rollers 66 and 67. The entire assembly with the roll of copy paper is then moved toward the right as viewed in FIGS. 2, 3 and 5 until the assembly is returned to the operative paper feeding position within the copying machine. The leading edge of the copy paper is then inserted into the nip of the feed rollers 68 and 70 so as to be fed thereby during the next actuation of the copying machine. The arms 150 and 152 and the bar 154 will be raised by contact of the peripheral surface of the roll of copy paper with the bar 154 when the assembly is moved into the copying machine as just described.

Variations and modifications to the apparatus disclosed will be apparent to those skilled in the art and it is intended that the invention shall be limited only in accordance with the scope of the following claims.

What is claimed is:

1. In a copying machine wherein copy paper is stored in roll form and utilized for making copies of original documents, apparatus for storing and feeding the copy paper, said apparatus comprising:

A. a frame,

B. means mounting said frame in the copying machine adjacent one end thereof for relative movement with respect to the copying machine between an operative copy paper feeding position wherein said frame is disposed within the copying machine and an inoperative copy paper loading position wherein said frame is disposed exteriorily of the copying machine, C. support means carried by said frame for rotatably supporting a roll of copy paper on the peripheral surface of said roll of copy paper with said roll of copy paper being free to rotate on said support means when said frame is in said operative copy paper feeding position, D. copy paper feeding means mounted within the copying machine for intermittently withdrawing a predetermined length of copy paper from said roll, said copy paper feeding means being disposed adjacent the end of the copying machine through which said frame is moved between said operative and inoperative positions, and, E. guide means carried by said frame and defining a copy paper path from said copy paper roll support means to said feeding means, said path extending generally upwardly from said roll support means and thence generally downwardly to said feeding means, said guide means comprising a subframe pivotally mounted on said frame adjacent the outer end thereof and movable therewith, said subframe being normally disposed in a vertically upright position and carrying guide rollers at the upper and lower ends thereof to define said copy paper path when said subframe is in said upright position.

2. Apparatus as set forth in claim 1 further including copy paper roll guide means pivotally mounted on said frame in position to normally contact the peripheral surface and outer edges of the roll of copy paper and being biased toward the roll of copy paper to maintain the roll of copy paper properly centered while the copy paper is being consumed.

3. Apparatus as set forth in claim 1 further including means interconnecting said subframe and said copy paper roll guide means whereby when said subframe is moved from said upright position to a depressed position said copy paper roll guide means is withdrawn from contact with the roll of copy paper.

4. Apparatus as set forth in claim 3 wherein said roll guide means comprises a pair of chaser rollers mounted on a bar, said bar being carried by a pair of links pivotally mounted on said frame, and means biasing said bar into contact with the peripheral surface of the roll of copy paper, said chaser rollers being spaced apart a distance just sufficient to allow the outer edges of the roll of copy paper to contact the inner edges of said chaser rollers.

5. Apparatus as set forth in claim 4 wherein said interconnecting means comprises a pair of links connected to said subframe adjacent the bottom thereof and being slidably connected to said first mentioned links, said interconnecting links operatively cooperating with said first mentioned links to withdraw said first mentioned links and said bar and chaser rollers from contact with the roll of copy paper when said subframe is moved from said upright position to said depressed position.

* * * * *